US009285734B2

(12) United States Patent
Kakishima et al.

(10) Patent No.: US 9,285,734 B2
(45) Date of Patent: Mar. 15, 2016

(54) IMAGE FORMING APPARATUS

(71) Applicant: FUJI XEROX CO., LTD., Minato-ku, Tokyo (JP)

(72) Inventors: Aya Kakishima, Kanagawa (JP); Miho Ikeda, Kanagawa (JP); Takaharu Nakajima, Kanagawa (JP); Koichiro Yuasa, Kanagawa (JP); Yasumitsu Harashima, Kanagawa (JP); Toko Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/311,956

(22) Filed: Jun. 23, 2014

(65) Prior Publication Data

US 2015/0168882 A1 Jun. 18, 2015

(30) Foreign Application Priority Data

Dec. 18, 2013 (JP) ..... 2013-261536

(51) Int. Cl.
*G03G 15/20* (2006.01)
*G03G 15/00* (2006.01)

(52) U.S. Cl.
CPC ..... *G03G 15/2053* (2013.01); *G03G 15/5062* (2013.01); *G03G 15/6573* (2013.01); *G03G 15/6585* (2013.01); *G03G 2215/0043* (2013.01); *G03G 2215/2032* (2013.01)

(58) Field of Classification Search
CPC ..... G03G 15/2028; G03G 15/2053; G03G 15/2085; G03G 2215/00805
USPC ..... 399/69, 322, 341, 407
See application file for complete search history.

(56) References Cited

U.S. PATENT DOCUMENTS

2012/0107004 A1* 5/2012 Sonohara et al. ..... 399/69
2012/0269559 A1* 10/2012 Fujita ..... 399/328

FOREIGN PATENT DOCUMENTS

JP 2004-029194 A 1/2004
JP 2006-317632 A 11/2006
JP 2006-317633 A 11/2006

* cited by examiner

*Primary Examiner* — Hoang Ngo
(74) *Attorney, Agent, or Firm* — Sughrue Mion, PLLC

(57) ABSTRACT

Provided is an image forming apparatus including a first image unit that uses toner which contains a flat pigment, a second image unit that uses toner which does not contain a flat pigment, and a fixing unit that fixes an image which is formed on a recording medium to the recording medium by using heat while transporting the recording medium, wherein the recording medium is transported again to the fixing unit after the image formed on the recording medium by the toner containing the flat pigment is fixed to the recording medium by the fixing unit.

7 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2013-261536 filed Dec. 18, 2013.

BACKGROUND

Technical Field

The present invention relates to an image forming apparatus.

SUMMARY

According to an aspect of the invention, there is provided an image forming apparatus including:

a first image unit that uses toner which contains a flat pigment;

a second image unit that uses toner which does not contain a flat pigment; and a fixing unit that fixes an image which is formed on a recording medium to the recording medium by using heat while transporting the recording medium, wherein the recording medium is transported again to the fixing unit after the image formed on the recording medium by the toner containing the flat pigment is fixed to the recording medium by the fixing unit.

BRIEF DESCRIPTION OF THE DRAWINGS

Exemplary embodiments of the present invention will be described in detail based on the following figures, wherein.

DETAILED DESCRIPTION

An example of an image forming apparatus according to an exemplary embodiment of the invention will be described with reference to FIGS. 1A to 9. An arrow H in each of the drawings represents an up-down direction of the apparatus, which is a vertical direction. An arrow W in each of the drawings represents a width direction of the apparatus, which is a horizontal direction.

<Overall Configuration of Image Forming Apparatus>

Figure 9:
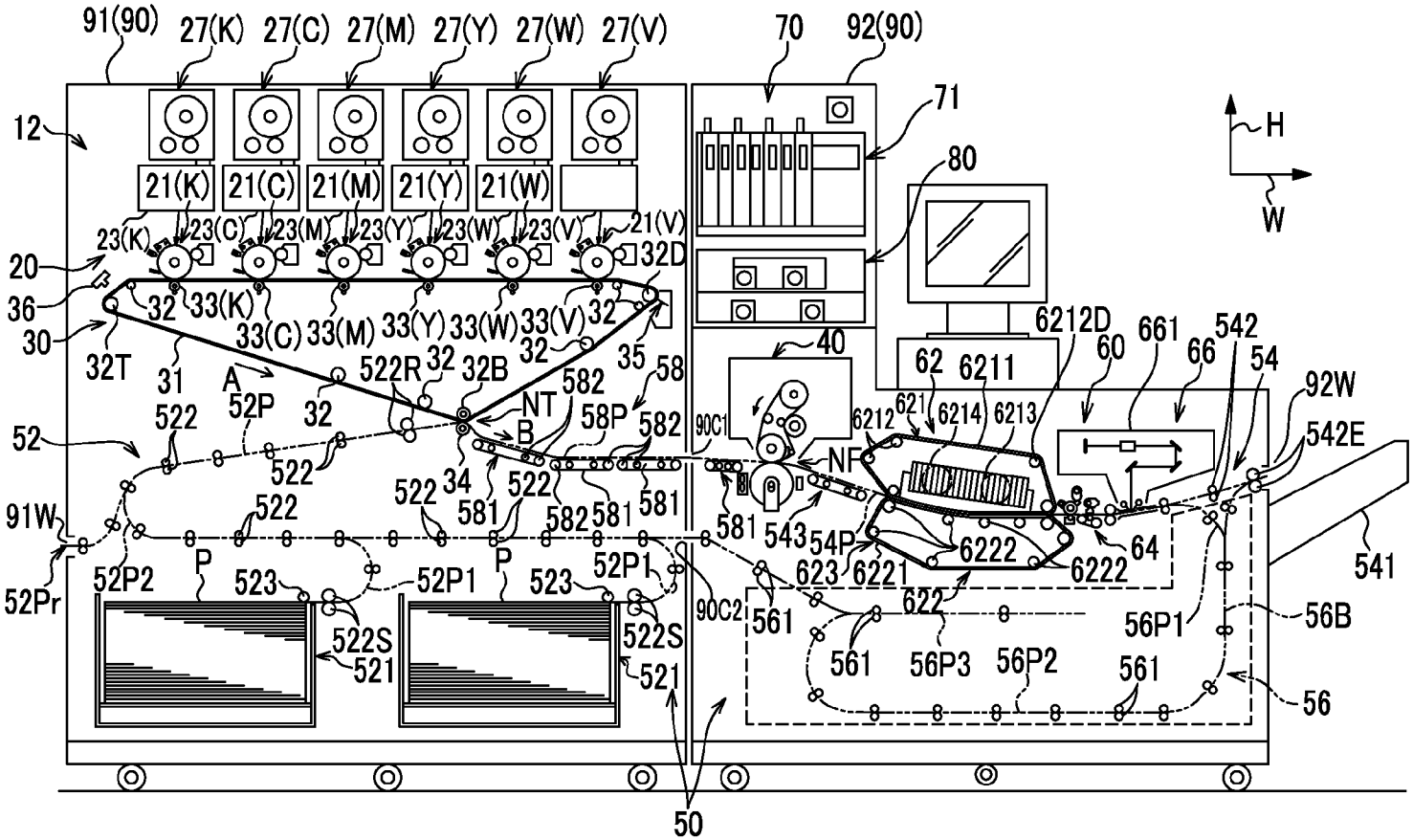
FIG. 9 is a schematic configuration diagram illustrating the image forming apparatus according to the exemplary embodiment of the invention.

FIG. 9 is a schematic diagram illustrating an overall configuration of an image forming apparatus 10 viewed from a front surface side. As is illustrated in the drawing, the image forming apparatus 10 is configured to include an image forming unit 12 that forms an image on a sheet member P as a recording medium by using electrophotography, a medium transport device 50 that transports the sheet member P, and a post-processing unit 60 that performs post-processing and the like on the sheet member P where the image is formed.

The image forming apparatus 10 is configured to further include a control unit 70 that performs control on each of the above-described units and a power supply unit 80 (described later), and the power supply unit 80 that supplies power to each of the above-described units including the control unit 70.

In addition, the image forming unit 12 is configured to include a toner image forming unit 20 that forms a toner image, a transfer device 30 that transfers the toner image formed by the toner image forming unit 20 to the sheet member P, and a fixing device 40 that fixes the toner image transferred to the sheet member P on the sheet member P.

The medium transport device 50 is configured to include a medium supply unit 52 that supplies the sheet member P to the image forming unit 12, and a medium discharge unit 54 that discharges the sheet member P where the toner image is formed. The medium transport device 50 is configured to further include a medium returning unit 56 that is used when the image is formed on both surfaces of the sheet member P, and an intermediate transport unit 58 (described later).

The post-processing unit 60 is configured to include a medium cooling unit 62 that cools the sheet member P to which the toner image is transferred in the image forming unit 12, a rectification device 64 that rectifies bending of the sheet member P, and an image inspection unit 66 that inspects the image which is formed on the sheet member P. Each of the units that constitute the post-processing unit 60 is arranged in the medium discharge unit 54 of the medium transport device 50.

Each of the units of the image forming apparatus 10, except for a discharged medium receiving unit 541 that constitutes the medium discharge unit 54 of the medium transport device 50, is accommodated in a housing 90. The housing 90 according to this exemplary embodiment is a two-piece structure including a first housing 91 and a second housing 92 that are adjacent to each other in the width direction of the apparatus. In this manner, a unit of transport of the image forming apparatus 10 is reduced in the width direction of the apparatus.

Main parts of the image forming unit 12 except for the fixing device 40 (described later) and the medium supply unit 52 are accommodated in the first housing 91. The fixing device 40 that constitutes the image forming unit 12, the medium discharge unit 54 except for the discharged medium receiving unit 541, the medium cooling unit 62, the image inspection unit 66, the medium returning unit 56, the control unit 70, and the power supply unit 80 are accommodated in the second housing 92. The first housing 91 and the second housing 92 are, as an example, coupled with each other by fasteners such as bolts and nuts (not illustrated). In the coupled state, a communication opening portion 90C1 for the sheet member P between a transfer nip NT (described later) of the image forming unit 12 and a fixing nip NF and a connecting path 90C2 for the sheet member P between the medium returning unit 56 and the medium supply unit 52 are formed between the first housing 91 and the second housing 92.

(Image Forming Unit)

As described above, the image forming unit 12 is configured to include the toner image forming unit 20, the transfer device 30, and the fixing device 40. The image forming unit 12 includes plural toner image forming units 20 so as to form the toner image by color. In this exemplary embodiment, the toner image forming units 20 are disposed for a total of six colors, that is, a first custom color (V), a second custom color (W), yellow (Y), magenta (M), cyan (C), and black (K). The (V), (W), (Y), (M), (C), and (K) illustrated in FIG. 9 represent the respective colors described above. The transfer device 30 transfers the toner images of the six colors to the sheet member P at the transfer nip NT from an image transfer belt 31 where the toner images of the six colors are superposed and primary image-transferred (described in detail later).

In this example, the first custom color (V) is, for example, silver, in which the toner containing a flat pigment that adds metallic gloss to the image is used. The second custom color (W) is a corporate color specific to a user, which is more frequently used than other colors. The silver toner and the control of each of the units by the control unit 70 performed when the image is formed by using the silver toner and the like will be described later.

<<Toner Image Forming Unit>>

Figure 7:
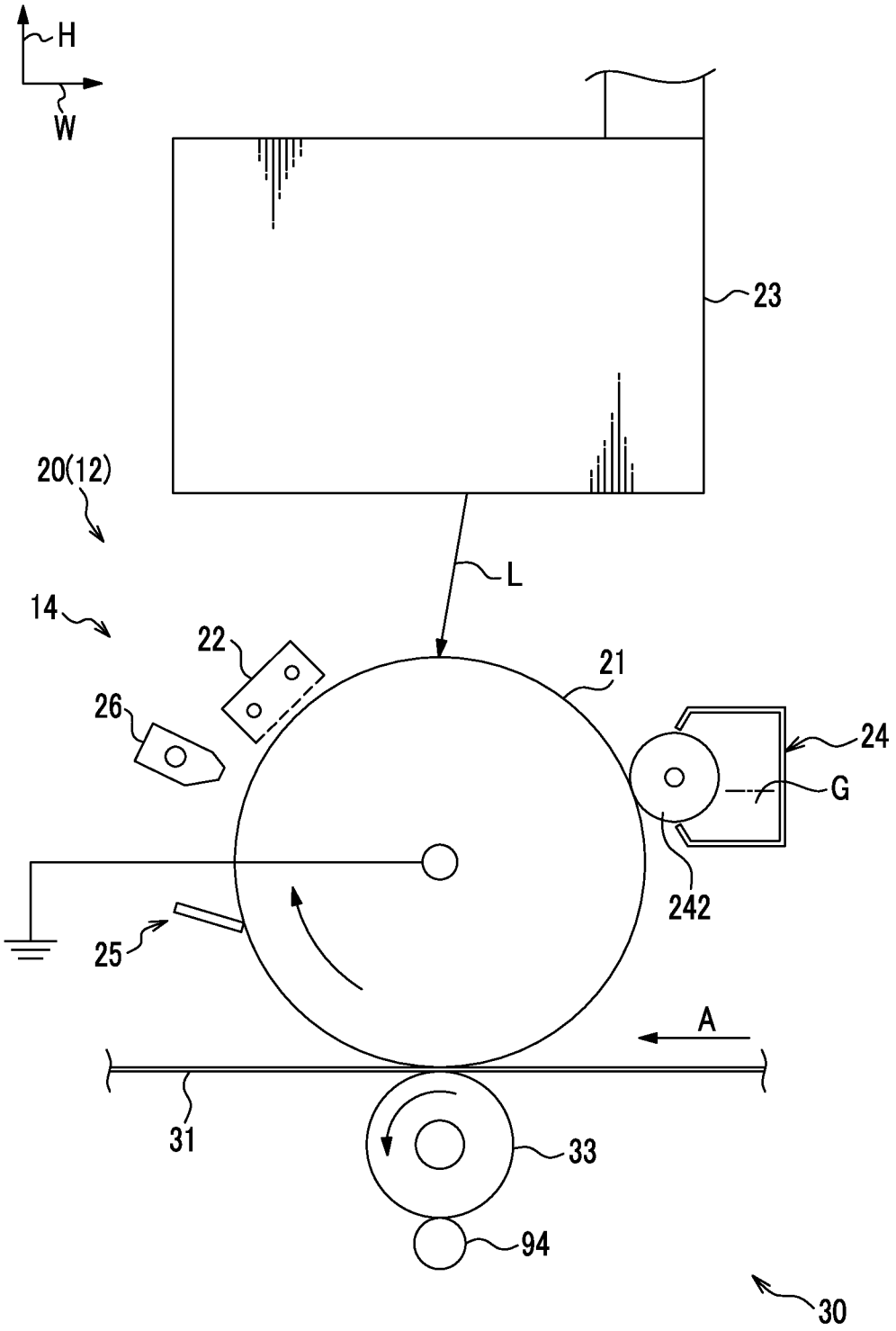
FIG. 7 is a side view illustrating a photoconductor drum and the like of the image forming apparatus according to the exemplary embodiment of the invention.

Basically, the toner image forming units 20 for the respective colors have the same configuration except for the toner that is used. Accordingly, image forming units 14 for the respective colors will not be particularly distinguished in the following description. The image forming unit 14 of the toner image forming unit 20 is configured to include a photoconductor drum 21 as an example of an image holding member, a charging unit 22, an exposure device 23, a developing device 24 as an example of a developing unit, a cleaning device 25, and an erasing device 26 as illustrated in FIG. 7.

[Photoconductor Drum]

The photoconductor drum 21 is formed into a cylindrical shape and grounded, and is driven to rotate about its own axis by a driver (not illustrated). A photosensitive layer that shows, for example, a negative charge polarity is formed on an outer surface of the photoconductor drum 21. As illustrated in FIG. 9, the photoconductor drums 21 for the respective colors are arranged side by side, in a linear shape, along the width direction of the apparatus when viewed from the front surface.

[Charging Unit]

As illustrated in FIG. 7, the charging unit 22 charges the outer surface of the photoconductor drum 21 (photosensitive layer) with a negative polarity. In this exemplary embodiment, the charging unit 22 is a corona discharge type (non-contact charge type) scoroton charging unit.

[Exposure Device]

The exposure device 23 forms an electrostatic latent image on the outer surface of the photoconductor drum 21. Specifically, the exposure device 23 irradiates the outer surface of the photoconductor drum 21 charged by the charging unit 22 with a modulated exposure light beam L according to image data received from an image signal processing unit 71 (refer to FIG. 9) that constitutes the control unit 70. The electrostatic latent image is formed on the outer surface of the photoconductor drum 21 through the irradiation with the exposure light beam L by the exposure device 23.

[Developing Device]

The developing device 24 develops the electrostatic latent image formed on the outer surface of the photoconductor drum 21 with a developer G that contains the toner, and forms the toner image on the outer surface of the photoconductor drum 21.

The toner is supplied to the developing device 24 from a toner cartridge 27 that holds the toner.

[Cleaning Device]

The cleaning device 25 has a blade shape, and scrapes the residual toner on the outer surface of the photoconductor drum 21 from the outer surface of the photoconductor drum 21 after the transfer of the toner image to the transfer device 30.

[Erasing Device]

The erasing device 26 performs charge removal by irradiating the photoconductor drum 21 after the transfer with light. In this manner, charge history of the outer surface of the photoconductor drum 21 is cancelled.

<<Transfer Device>>

The transfer device 30 superposes the toner images of the photoconductor drums 21 for the respective colors on the image transfer belt 31 for the primary image transfer, and secondary image-transfers the superposed toner images to the sheet member P. This will be described in detail later.

[Image Transfer Belt]

Figure 8:
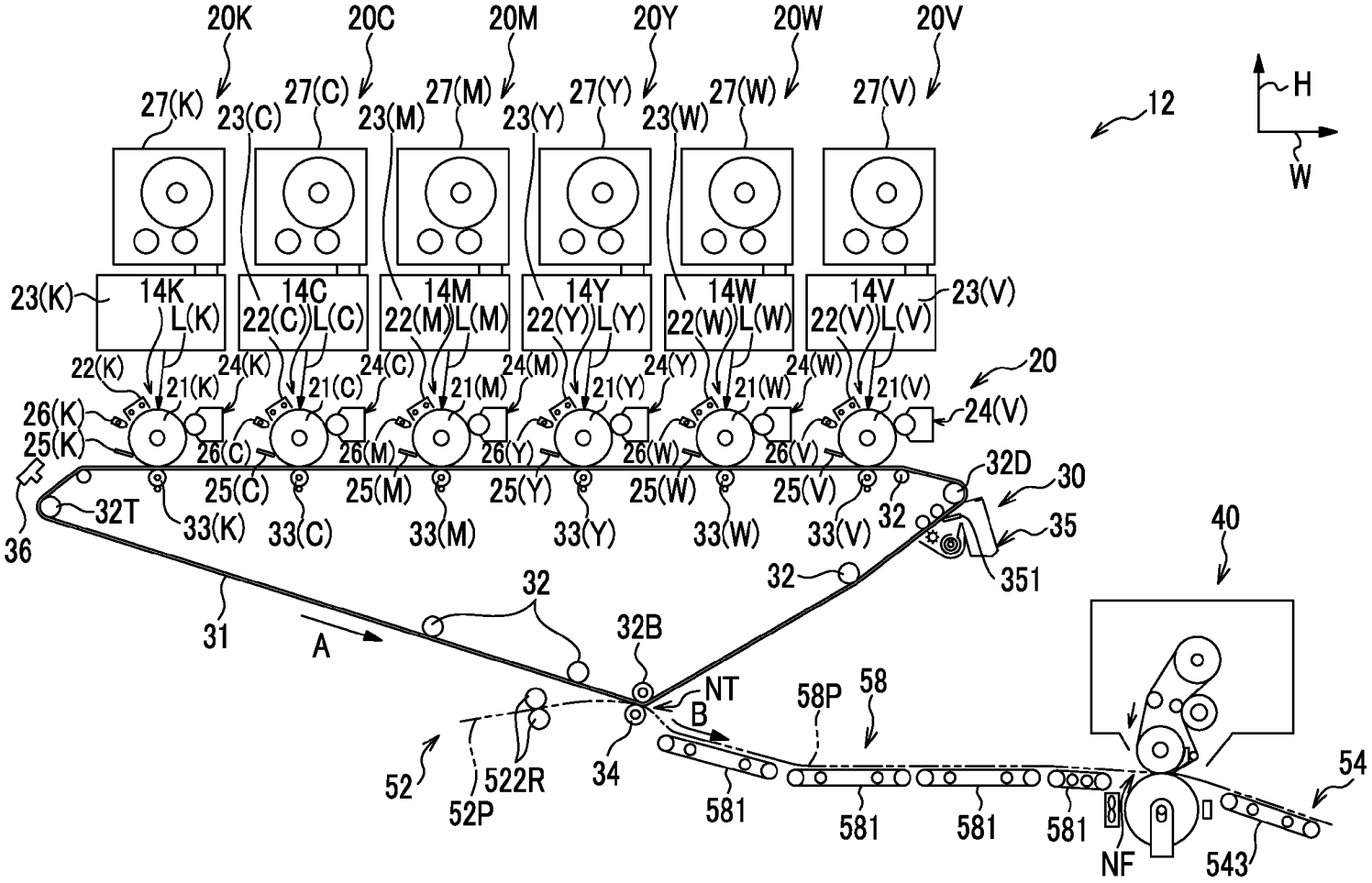
FIG. 8 is a configuration diagram illustrating an image forming unit of the image forming apparatus according to the exemplary embodiment of the invention.

As illustrated in FIG. 8, the image transfer belt 31 has an endless shape, and a posture thereof is determined with the image transfer belt 31 being wound around plural rollers 32. In this exemplary embodiment, the image transfer belt 31 has a reverse obtuse angle triangular-shape posture and is long in the width direction of the apparatus when viewed from the front surface. Of the plural rollers 32, a roller 32D illustrated in FIG. 8 functions as a driving roller that allows the image transfer belt 31 to revolve in an arrow A direction by driving of a motor (not illustrated).

Of the plural rollers 32, a roller 32T illustrated in FIG. 8 functions as a tensile strength applying roller that applies tensile strength to the image transfer belt 31. Of the plural rollers 32, a roller 32B illustrated in FIG. 8 functions as a roller facing a secondary image transfer roller 34 (described later). A lower end side apex of the image transfer belt 31, having the reverse obtuse angle triangular-shaped posture as described above, which forms an obtuse angle is wound around the roller 32B. The image transfer belt 31 comes into contact, from below, with the photoconductor drums 21 for the respective colors in an upper side portion that extends in the width direction of the apparatus in the posture described above.

[Primary Image Transfer Roller]

Primary image transfer rollers 33 as an example of transfer members are arranged on an inner side of the image transfer belt 31 to transfer the toner images of the respective photoconductor drums 21 to the image transfer belt 31. The respective primary image transfer rollers 33 are arranged to face the photoconductor drums 21 for the corresponding colors across the image transfer belt 31. In addition, an image-transferring bias voltage having the polarity opposite to a toner polarity is applied to the primary image transfer rollers 33. The toner image that is formed in the photoconductor drum 21 is transferred to the image transfer belt 31 when the image-transferring bias voltage is applied.

[Secondary Image Transfer Roller]

In addition, the transfer device 30 includes the secondary image transfer roller 34 that transfers the toner images superposed on the image transfer belt 31 to the sheet member P. The secondary image transfer roller 34 is arranged to nip the image transfer belt 31 between the secondary image transfer roller 34 and the roller 32B, and forms the transfer nip NT between the image transfer belt 31 and the secondary image transfer roller 34. The sheet member P is supplied, on a timely basis, from the medium supply unit 52 to the transfer nip NT. The image-transferring bias voltage having the polarity opposite to the toner polarity is applied to the secondary image transfer roller 34 by a power supply unit (not illustrated). When the image-transferring bias voltage is applied, the toner image is transferred from the image transfer belt 31 to the sheet member P passing through the transfer nip NT.

[Cleaning Device]

The transfer device 30 further includes a cleaning device 35 that cleans the image transfer belt 31 after the secondary image transfer. The cleaning device 35 is arranged on a downstream side of a part where the secondary image transfer is performed (transfer nip NT) and on an upstream side of a part where the primary image transfer is performed in a revolving direction of the image transfer belt 31. The cleaning device 35 includes a blade 351 that scrapes the residual toner on an outer surface of the image transfer belt 31 from the outer surface of the image transfer belt 31.

<<Fixing Device: Overview>>

The fixing device 40 fixes the toner image, by using heat, to the sheet member P to which the toner image is transferred by the transfer device 30. A detailed configuration of the fixing device and the control of each of the members by the control unit 70 will be described in detail later.

(Medium Transport Device)

As illustrated in FIG. 9, the medium transport device 50 is configured to include the medium supply unit 52, the medium discharge unit 54, the medium returning unit 56, and the intermediate transport unit 58.

<<Medium Supply Unit>>

The medium supply unit 52 includes an accommodator 521 in which the sheet members P are stacked and accommodated. In this exemplary embodiment, two accommodators 521 are arranged side by side, along the width direction of the apparatus, below the transfer device 30.

A medium supply path 52P is formed, from each of the accommodators 521 to the transfer nip NT that is a secondary image transfer position, by plural transport roller pairs 522, a guide (not illustrated), and the like. The medium supply path 52P is shaped (has a substantially "S" shape) to rise and reach the transfer nip NT while being folded back in the width direction of the apparatus in two folded portions 52P1 and 52P2.

A feed roller 523 that feeds the uppermost sheet member P stacked in the accommodator 521 is arranged on an upper side of each of the accommodators 521. Of the plural transport roller pairs 522, a transport roller pair 522S on the most upstream side in a transport direction of the sheet member P functions as a separating roller that separates the sheet members P, which are fed in a stacked manner from the accommodator 521 by the feed roller 523, sheet by sheet. Of the plural transport roller pairs 522, a transport roller pair 522R that is positioned on an immediately upstream side of the transfer nip NT in the transport direction of the sheet member P is operated to match a movement timing of the toner image on the image transfer belt 31 with a transport timing of the sheet member P.

The medium supply unit 52 further includes a preliminary transport path 52Pr. The preliminary transport path 52Pr starts from an opening portion 91W of the first housing 91 on the side opposite to a second housing 92 side, and joins the folded portion 52P2 of the medium supply path 52P. The preliminary transport path 52Pr is a transport path that is used when the sheet member P, which is fed from an optional recording medium supply device (not illustrated) arranged to be adjacent to the opening portion 91W side of the first housing 91, is sent to the image forming unit 12.

<<Intermediate Transport Unit>>

As illustrated in FIG. 8, the intermediate transport unit 58 includes plural belt transport members 581 that are arranged between the transfer nip NT of the transfer device 30 and the fixing nip NF of the fixing device 40 and include endless-shaped transport belts which are wound around rollers.

The sheet member P is transported by revolving the transport belts while suctioning air (negative pressure suction) from inner sides of the belt transport members 581 and suctioning the sheet member P to outer surfaces of the transport belts.

<<Medium Discharge Unit>>

As illustrated in FIG. 9, the medium discharge unit 54 discharges the sheet member P, where the toner image is fixed by the fixing device 40 of the image forming unit 12, out of the housing 90 from a discharge port 92W that is formed in an end portion on the side opposite to the first housing 91 side of the second housing 92.

The medium discharge unit 54 includes the discharged medium receiving unit 541 that receives the sheet member P which is discharged from the discharge port 92W.

The medium discharge unit 54 includes a medium discharge path 54P that transports the sheet member P from the fixing device 40 (fixing nip NF) to the discharge port 92W. The medium discharge path 54P is formed from a belt transport member 543, plural roller pairs 542, a guide (not illustrated), and the like. Of the plural roller pairs 542, a roller pair 542E that is arranged on the most downstream side in a discharge direction of the sheet member P functions as a discharge roller that discharges the sheet member P onto the discharged medium receiving unit 541.

<<Medium Returning Unit>>

The medium returning unit 56 includes plural roller pairs 561. The plural roller pairs 561 form a reversal path 56P through which the sheet member P passing through the image inspection unit 66 is sent when it is required for the image to be formed on both surfaces. The reversal path 56P includes a branch path 56P1, a transport path 56P2, and a reverse path 56P3. The branch path 56P1 branches from the medium discharge path 54P. The transport path 56P2 sends the sheet member P received from the branch path 56P1 to the medium supply path 52P. The reverse path 56P3 is disposed in a middle of the transport path 56P2, and turns the sheet member P inside out by folding (switching-transporting) the sheet member P transported through the transport path 56P2 into the direction opposite to the transport direction.

(Post-Processing Unit)

The medium cooling unit 62, the rectification device 64, and the image inspection unit 66 that constitute the post-processing unit 60 are arranged in this order, from an upstream side of the discharge direction, on the upstream side in the discharge direction of the sheet member P with respect to a branch part of the branch path 56P1 on the medium discharge path 54P of the medium discharge unit 54.

<<Medium Cooling Unit>>

The medium cooling unit 62 includes a heat absorbing device 621 that absorbs heat of the sheet member P, and a pressing device 622 that presses the sheet member P to the heat absorbing device 621. The heat absorbing device 621 is arranged on an upper side with respect to the medium discharge path 54P, and the pressing device 622 is arranged on a lower side with respect to the medium discharge path 54P.

The heat absorbing device 621 is configured to include an endless-shaped heat absorption belt 6211, plural rollers 6212 that support the heat absorption belt 6211, a heatsink 6213 that is arranged in the heat absorption belt 6211, and a fan 6214 that cools the heatsink 6213.

An outer circumferential surface of the heat absorption belt 6211 is in contact with the sheet member P to be capable of heat exchange. Of the plural rollers 6212, a roller 6212D functions as a driving roller that transmits a driving force to the heat absorption belt 6211. The heatsink 6213 is in surface contact, in a slidable manner, with an inner circumferential surface of the heat absorption belt 6211 in a range that is determined along the medium discharge path 54P.

The pressing device 622 includes an endless-shaped pressing belt 6221, and plural rollers 6222 that support the pressing belt 6221. The pressing belt 6221 is wound around the plural rollers 6222. The pressing device 622 transports the sheet member P with the heat absorption belt 6211 while pressing the sheet member P to the heat absorption belt 6211 (heatsink 6213).

<<Rectification Device>>

The rectification device 64 is disposed on a downstream side of the medium cooling unit 62 in the medium discharge unit 54. The rectification device 64 rectifies the bending (curling) of the sheet member P that is received from the medium cooling unit 62.

<<Image Inspection Unit>>

An inline sensor 661 that forms a main part of the image inspection unit 66 is arranged on a downstream side of the rectification device 64 in the medium discharge unit 54. The inline sensor 661 detects the presence or absence and degree of a toner concentration defect, an image defect, an image position defect, and the like of the fixed toner image based on the light which is reflected from the sheet member P after the sheet member P is irradiated with the light.

<Image Forming Operation (Effect) of Image Forming Apparatus>

Next, an image forming process performed on the sheet member P by the image forming apparatus 10 and a post-processing process will be described in summary.

As illustrated in FIG. 9, the control unit 70 operates the toner image forming unit 20, the transfer device 30, and the fixing device 40 when an image forming command is received. Then, the photoconductor drums 21 of the image forming units 14 for the respective colors and developing rollers 242 of the developing devices 24 rotate as illustrated in FIG. 8, and the image transfer belt 31 revolves. In addition, the pressurizing roller 42 rotates and a fixing belt 411 revolves. Furthermore, the control unit 70 operates the medium transport device 50 in synchronization with these operations.

In this manner, the photoconductor drums 21 for the respective colors are charged by the charging unit 22 while rotating. The control unit 70 sends image data image-processed by the image signal processing unit to the respective exposure devices 23. The respective exposure devices 23 emit exposure light beams L according to the image data, and the charged photoconductor drums 21 are exposed. Then, the electrostatic latent image is formed on each of the outer surfaces of the photoconductor drums 21. The electrostatic latent image formed in each of the photoconductor drums 21 is developed by the developer that is supplied from the developing device 24. In this manner, the toner images of the corresponding colors, that is, the first custom color (V), the second custom color (W), yellow (Y), magenta (M), cyan (C), and black (K), are formed in the photoconductor drums 21 for the respective colors.

The toner images of the respective colors formed in the photoconductor drums 21 for the respective colors are sequentially transferred to the revolving image transfer belt 31 as the image-transferring bias voltage is applied through the primary image transfer rollers 33 for the respective colors. In this manner, the superposed toner images in which the toner images for the six colors are superposed are formed on the image transfer belt 31. The superposed toner images are transported to the transfer nip NT since the image transfer belt 31 revolves.

The sheet member P is supplied to the transfer nip NT, as illustrated in FIG. 9, with the timing matched with the transport of the superposed toner images by the transport roller pair 522R of the medium supply unit 52. The toner images superposed from the image transfer belt 31 are transferred to the sheet member P since the image-transferring bias voltage is applied at the transfer nip NT.

The sheet member P to which the toner image is transferred is transported from the transfer nip NT of the transfer device 30 toward the fixing nip NF of the fixing device 40 by the intermediate transport unit 58. The fixing device 40 applies heat and pressure to the sheet member P passing through the fixing nip NF. In this manner, the toner image that is transferred to the sheet member P is fixed.

The sheet member P that is discharged from the fixing device 40 is subjected to processing by the post-processing unit 60 while being transported by the medium discharge unit 54 toward the discharged medium receiving unit 541 out of the apparatus. The sheet member P that is heated through a fixing process is cooled first by the medium cooling unit 62. Then, the bending of the sheet member P is rectified by the rectification device 64. Furthermore, the presence or absence and degree of the toner concentration defect, the image defect, the image position defect, and the like of the toner image that is fixed to the sheet member P are detected by the image inspection unit 66. Then, the sheet member P is discharged to the medium discharge unit 54.

When the image is to be formed on a no-image surface of the sheet member P where the image is not formed (when two-sided printing is performed), the control unit 70 switches the transport path of the sheet member P after passing through the image inspection unit 66 from the medium discharge path 54P of the medium discharge unit 54 to the branch path 56P1 of the medium returning unit 56. Then, the sheet member P is turned inside out through the reversal path 56P and sent to the medium supply path 52P, and the image is formed (fixed) on the back surface of the sheet member P through the same image forming process as the above-described image forming process performed on the outer surface. The sheet member P is discharged to the discharged medium receiving unit 541 out of the apparatus by the medium discharge unit 54 through the same process as the above-described process following the image forming performed on the outer surface.

<Main Part Configuration>

Next, the silver toner that is used in the first custom color (V), the fixing device 40 (one example of a fixing unit), and the control by the control unit 70 that is performed when the image is formed by using the silver toner will be described.

(Toner)

Figure 1A:
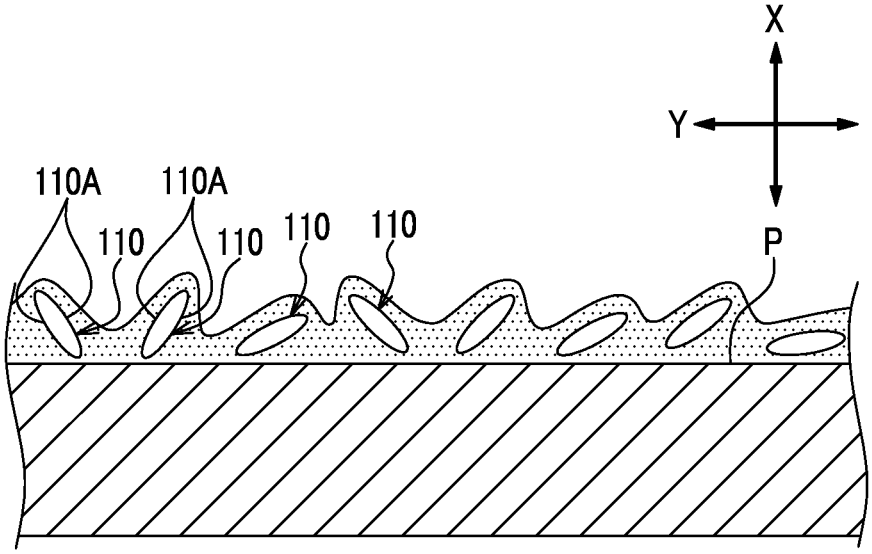
FIGS. 1A and 1B are cross-sectional views in which postures of flat pigments that are contained in a toner image which is formed by an image forming apparatus according to an exemplary embodiment of the invention are illustrated along with a comparative example.
Figure 1B:
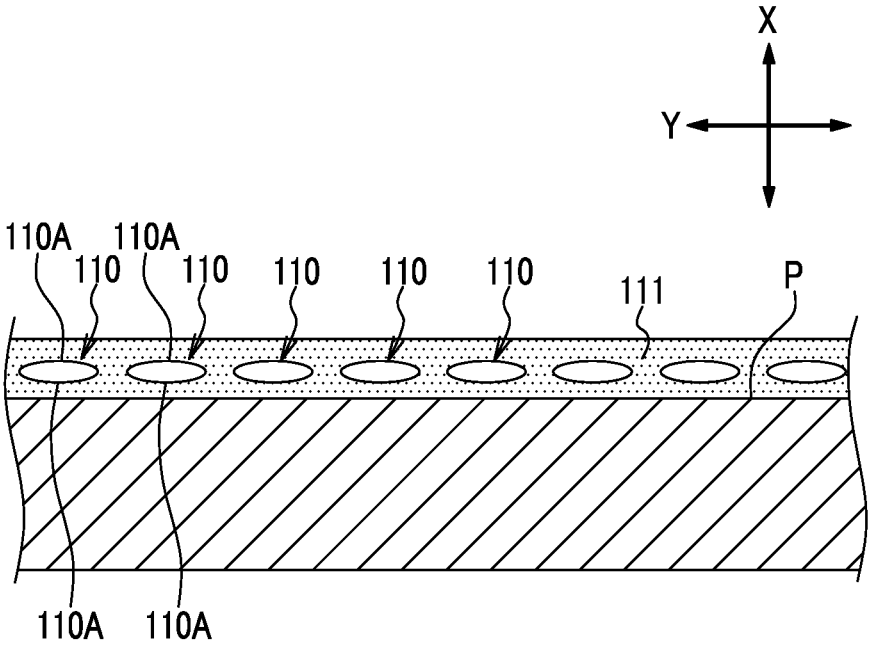

As illustrated in FIG. 1B, the silver toner that is used as the first custom color (V) is configured to contain pigments 110 as an example of the flat pigment and a binder resin 111, and is used when the metallic gloss is applied to the image. The image to which the metallic gloss is applied refers to an image that is formed by using the silver toner and a non-silver toner and an image that is formed by using only the silver toner.

The pigment 110 may include metals such as gold, silver, and copper, carbon black, titanium oxide, zinc oxide, barium sulfate, aluminum borate, potassium titanate and tin oxide. However, the material of the pigment 110 is not limited to these examples. In this example, the pigment 110 is formed of aluminum. When the pigment 110 is placed on a flat surface and viewed from a side, the pigment 110 is shaped such that a size in a left-right direction in the drawing is longer than a size in the up-down direction in the drawing as illustrated in FIG. 3B.

Figure 3A:
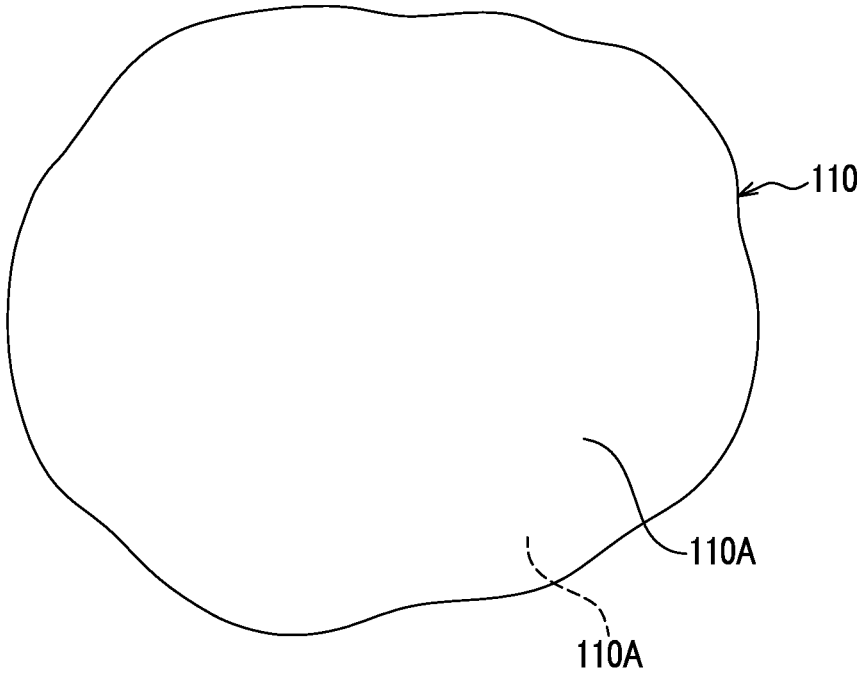
FIGS. 3A and 3B are a plan view and a side view of the flat pigment that is contained in toner which is used in the image forming apparatus according to the exemplary embodiment of the invention.
Figure 3B:
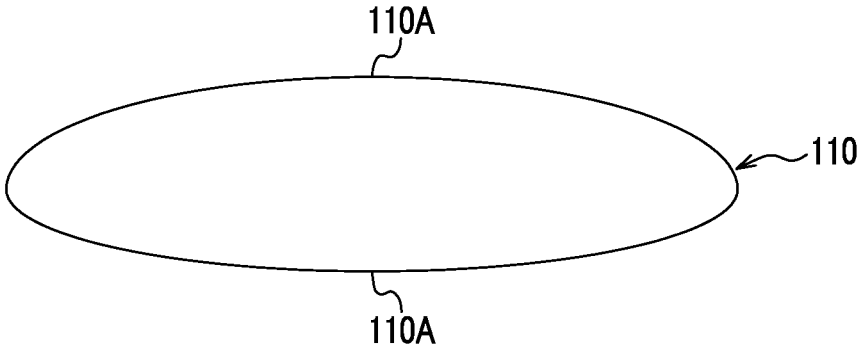

Furthermore, when the pigment 110 illustrated in FIG. 3B is viewed from above in the drawing, the pigment 110 has a wider shape than when viewed from the side as illustrated in FIG. 3A. In a state where the pigment 110 is placed on the flat surface (refer to FIG. 3B), the pigment 110 has a pair of reflecting surfaces 110A (flat surfaces) directed above or below. In this manner, the pigment 110 has a flat shape.

The non-silver toner (hereinafter, simply referred to as a "toner of another color") used as the second custom color (W), yellow (Y), magenta (M), cyan (C), and black (K) is configured to contain a pigment (for example, an organic pigment and an inorganic pigment) that does not contain the flat pigment and the binder resin.

(Fixing Device: Detail)

Figure 6:
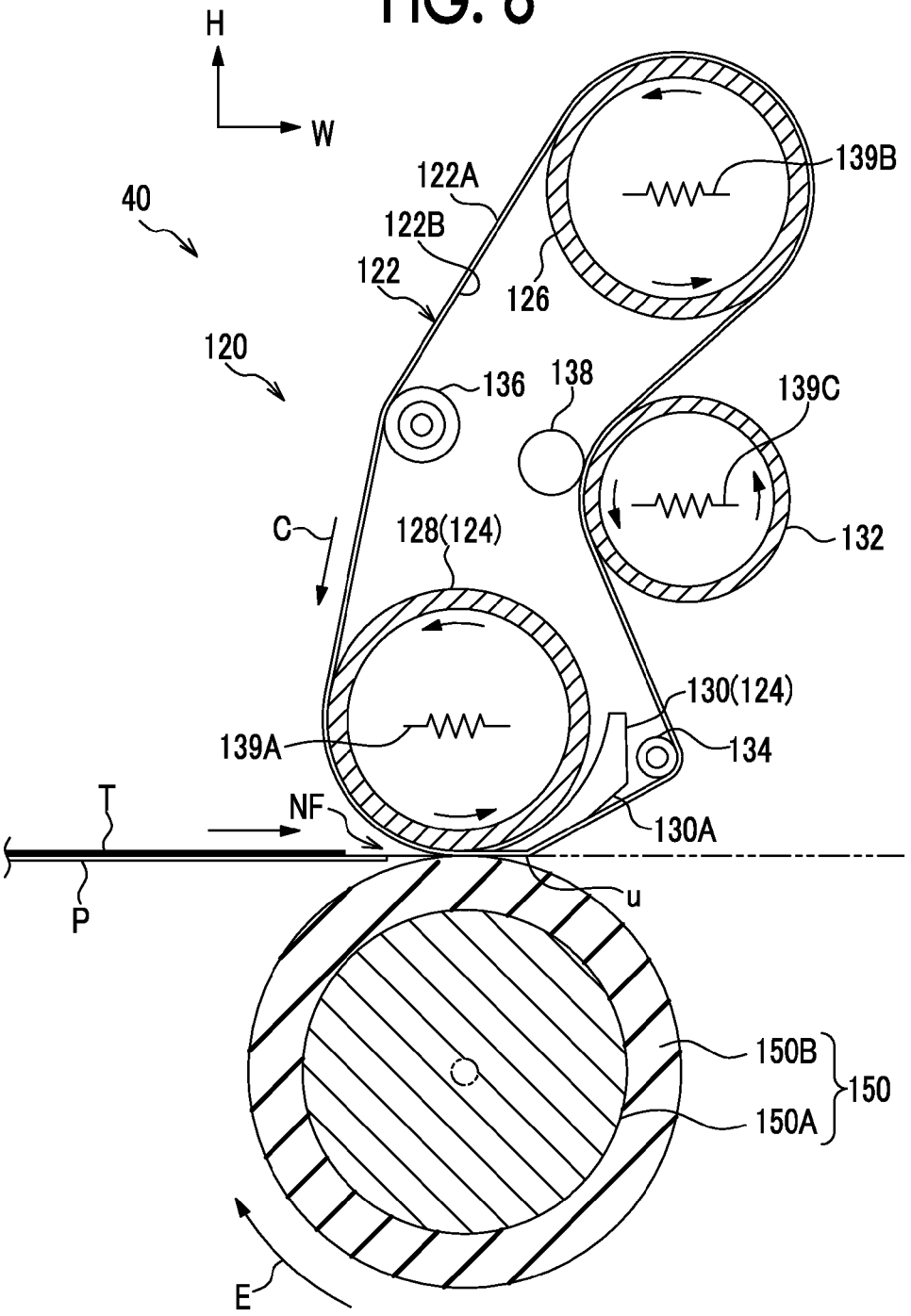
FIG. 6 is a cross-sectional view illustrating the fixing device that is used in the image forming apparatus according to the exemplary embodiment of the invention.

As illustrated in FIG. 6, the fixing device 40 includes a fixing module 120 as an example of a heating member that includes an endless-shaped fixing belt 122, and a pressurizing roller 150 as an example of a contact member that pressurizes the fixing module 120 in contact therewith. In addition, the fixing nip NF where the fixing belt 122 and the pressurizing roller 150 come into contact with each other is formed between the fixing belt 122 and the pressurizing roller 150.

<<Fixing Module>>

The fixing module 120 includes the above-described fixing belt 122, a supporting member 124, and an internal heating roller 126. The fixing belt 122 fixes the toner image formed on the sheet member P to the sheet member P by heating the toner image while revolving to transport the sheet member P. The supporting member 124 supports the fixing belt 122 by receiving a pressurizing force of the pressurizing roller 150 at a position on an inner side of the fixing belt 122 which corresponds to the fixing nip NF. The internal heating roller 126 is arranged on the side of the inner side of the fixing belt 122 which is opposite to the fixing nip NF, and the fixing belt 122 is wound around the internal heating roller 126.

Although not illustrated herein, an elastic layer formed of silicone rubber is formed on a polyimide base material, for example, in the fixing belt 122. Furthermore, a fluorine resin-based release layer is formed on the elastic layer.

The supporting member 124 includes a fixing roller 128 as an example of a rotating member and a peeling pad 130 as an example of a peeling member, and the fixing roller 128 and the peeling pad 130 are arranged in this order from an upstream side of the transport direction of the sheet member P. When torque of a motor (not illustrated) is transmitted to the fixing roller 128, the fixing roller 128 rotates and the fixing belt 122 revolves in an arrow C direction.

The peeling pad 130 is configured to have an outer side surface 130A where a corner portion U that bends the fixing belt 122 is formed. When a leading edge of the sheet member P passes through the corner portion U, the leading edge of the sheet member P is peeled off from the fixing belt 122.

Furthermore, a support roller 134, a support roller 136, and a support roller 138 around which the fixing belt 122 is wound are arranged on the inner side of the fixing belt 122.

The support roller 134 is arranged on a downstream side with respect to the peeling pad 130 in a revolving direction of the fixing belt 122. Furthermore, the support roller 136 and the support roller 138 are arranged between the fixing roller 128 and the internal heating roller 126 in the vertical up-down direction.

The fixing module 120 further includes an external heating roller 132 that is arranged on an outer circumferential side of the fixing belt 122 to define a revolving path of the fixing belt 122. The external heating roller 132 is arranged to nip the fixing belt 122 between the support roller 138 and the external heating roller 132.

Halogen lamps 139A, 139B, and 139C are arranged, as an example of heaters, on inner sides of the fixing roller 128, the internal heating roller 126, and the external heating roller 132. The fixing roller 128 and the internal heating roller 126 are in contact with an inner circumferential surface 122B of the fixing belt 122 to heat the inner side of the fixing belt 122, and the external heating roller 132 is in contact with an outer circumferential surface 122A of the fixing belt 122 to heat the fixing belt 122 from outside.

<<Pressurizing Roller>>

As for the pressurizing roller 150, an outer circumference of a columnar roller main body 150A formed of, for example, aluminum is coated with an elastic body layer 150B formed of silicone rubber. Although not illustrated, a fluorine resin-based peeling layer with a thickness of 100 μm is formed on an outer circumferential surface of an outer circumference of the elastic body layer 150B. When the torque of the motor (not illustrated) is transmitted, the pressurizing roller 150 rotates in an arrow E direction in the drawing at a circumferential speed equal to a circumferential speed of the fixing belt 122.

(Control Unit)

When the control unit 70 receives the image forming command to apply the metallic gloss to at least a part of the image, the control unit 70 operates a silver toner image forming unit 20V (example of a first image unit) along with the toner image forming units 20 for the other colors (examples of second image units).

The other configuration of the control unit 70 will be described with an effect of the main part configuration (described later).

<Effect of Main Part Configuration>

Next, the effect of the main part configuration will be described.

The control unit 70 that receives the image forming command to apply the metallic gloss to at least a part of the image operates the silver toner image forming unit 20V in the same manner as the toner image forming units 20 for the other colors as illustrated in FIG. 8.

Specifically, the electrostatic latent image that corresponds to a site where the metallic gloss is applied to the image is formed on an outer surface of a photoconductor drum 21V. The electrostatic latent image is formed on the entire outer surface of the photoconductor drum 21V when the metallic gloss is applied to the entire surfaces of the sheet member P. When the metallic gloss is applied to a part thereof, the electrostatic latent image that corresponds to the part is formed.

The electrostatic latent image that is formed on the photoconductor drum 21V is developed by the developer containing the silver toner which is supplied from a developing device 24V. In this manner, a silver toner image is formed on the photoconductor drum 21V.

The silver toner image is transferred to the revolving image transfer belt 31, and the toner images of the other colors are sequentially transferred to the image transfer belt 31 after the silver toner image is transferred to the image transfer belt 31. In this manner, the superposed toner images, in which the toner images of the six colors are superposed, are formed on the image transfer belt 31. The superposed toner images (hereinafter, simply referred to as "toner images") are transferred from the image transfer belt 31 to one surface of the sheet member P at the transfer nip NT.

The sheet member P to which the toner images are transferred is transported from the transfer nip NT of the transfer device 30 toward the fixing nip NF of the fixing device 40 by the intermediate transport unit 58. The fixing device 40 applies heat and pressure to the sheet member P that passes through the fixing nip NF. In this manner, the toner image transferred to the sheet member P is fixed. In other words, as illustrated in FIG. 6, the toner image is fixed to the sheet member P (primary fixing) when the fixing belt 122 of the fixing module 120 that constitutes the fixing device 40 is in contact with one surface of the sheet member P where the toner image ("T" in FIG. 6) is formed and the heat is applied to the toner image.

Furthermore, as illustrated in FIG. 9, the control unit 70 switches the transport path of the sheet member P after passing through the image inspection unit 66 from the medium discharge path 54P of the medium discharge unit 54 to the branch path 56P1 of the medium returning unit 56. Then, the sheet member P is turned inside out through the reversal path 56P and sent to the medium supply path 52P.

In addition, the control unit 70 does not allow the toner image forming unit 20 to form the toner image. In this manner, the sheet member P that is sent to the medium supply path 52P passes through the transfer nip NT without the toner image being transferred. In other words, the sheet member P is transported in a state where the other surface of the sheet member P, where the toner image is not formed, faces upward.

Figure 5:
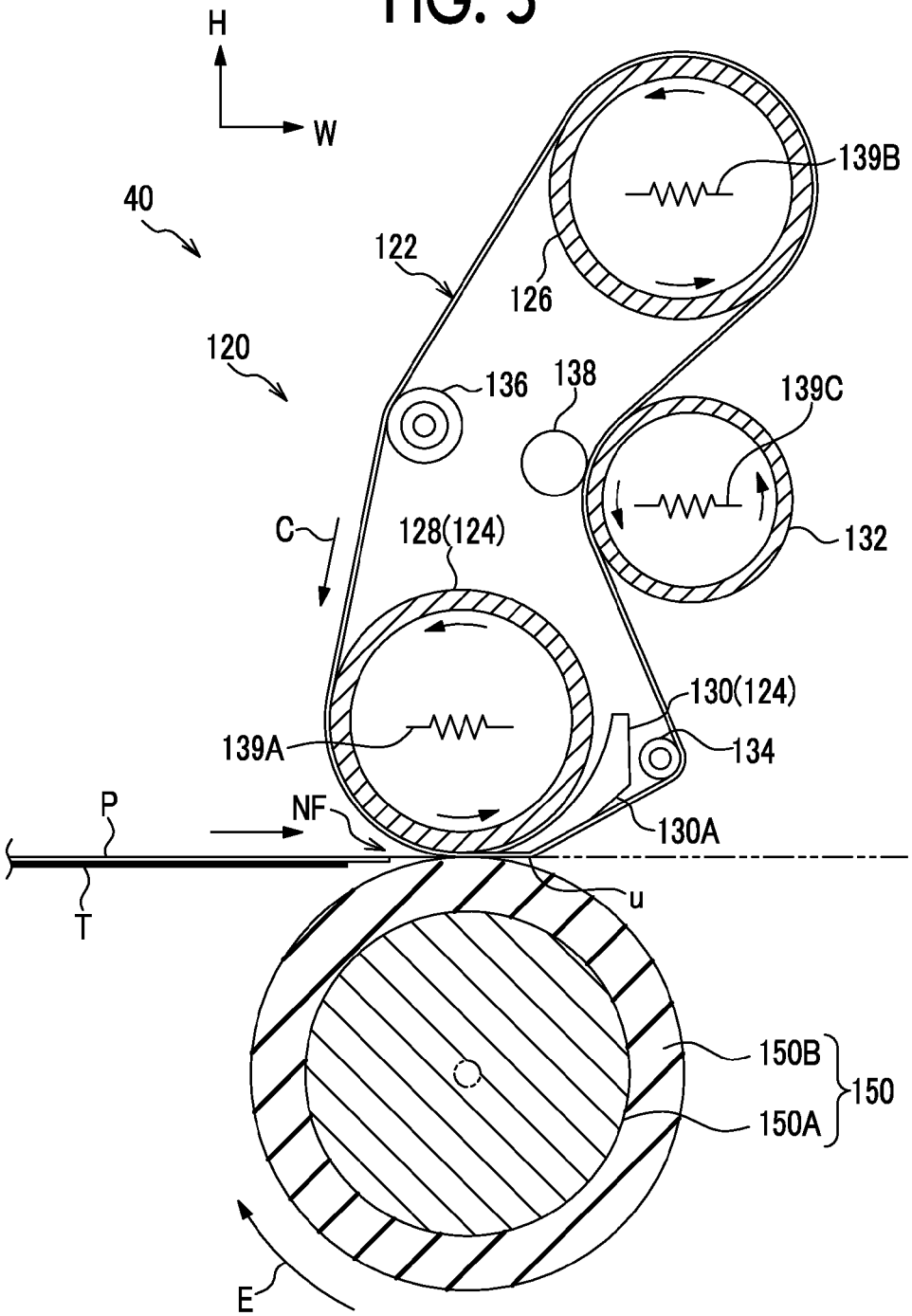
FIG. 5 is a cross-sectional view illustrating a fixing device that is used in the image forming apparatus according to the exemplary embodiment of the invention.

Furthermore, the sheet member P is transported toward the fixing nip NF of the fixing device 40 by the intermediate transport unit 58. The fixing device 40 applies heat and pressure to the sheet member P passing through the fixing nip NF. Specifically, as illustrated in FIG. 5, the fixing belt 122 of the fixing module 120 that constitutes the fixing device 40 is in contact with the other surface of the sheet member P where the toner image ("T" in FIG. 5) is not formed, and the heat is applied to the toner image from the other surface of the sheet member P (secondary fixing).

In other words, the fixing belt 122 is in contact with the one surface of the sheet member P where the toner image is formed when the sheet member P is transported to the fixing device 40 for the first time, and the fixing belt 122 is in contact with the other surface of the sheet member P when the sheet member P is transported again to the fixing device 40.

When the control unit 70 receives the image forming command not to apply the metallic gloss to the image (when the silver toner is not used), the sheet member P is discharged (refer to FIG. 9) to the discharged medium receiving unit 541 out of the apparatus by the medium discharge unit 54 without being transported again by the fixing device 40 (without being secondarily fixed).

In this manner, the control unit 70 increases the amount of heat applied to the toner image at a time when the control unit 70 receives the image forming command to apply the metallic gloss to the image (when the silver toner is used) to be higher than the amount of heat applied to the toner image at a time when the image forming command is received not to apply the metallic gloss to the image (when the silver toner is not used).

<Evaluation>

Next, a result of an ASTM E2194-based measurement of the flop index value (FI: flop index value) of the image that is formed on the sheet member P by the silver toner will be described with reference to FIG. 4. The flop index value is an index representing the metallic gloss. The larger the value is, the more improved the metallic gloss is.

<<Evaluation Specification>>

1. OS coated paper W (manufactured by Fuji Xerox Inter-Field, basis weight: 127 [g/m2], smoothness measured based on JISP 8119: 4,735[sec]) is used as the sheet member P.

2. Only the silver toner is used as the toner.

3. The outer surface temperature of the pressurizing roller 150 is 70 [° C.] or 135[° C.], and the amount of heat applied to the toner image formed on the sheet member P is changed by changing the outer surface temperature of the fixing belt 122.

<<Evaluation Result>>

Figure 4:
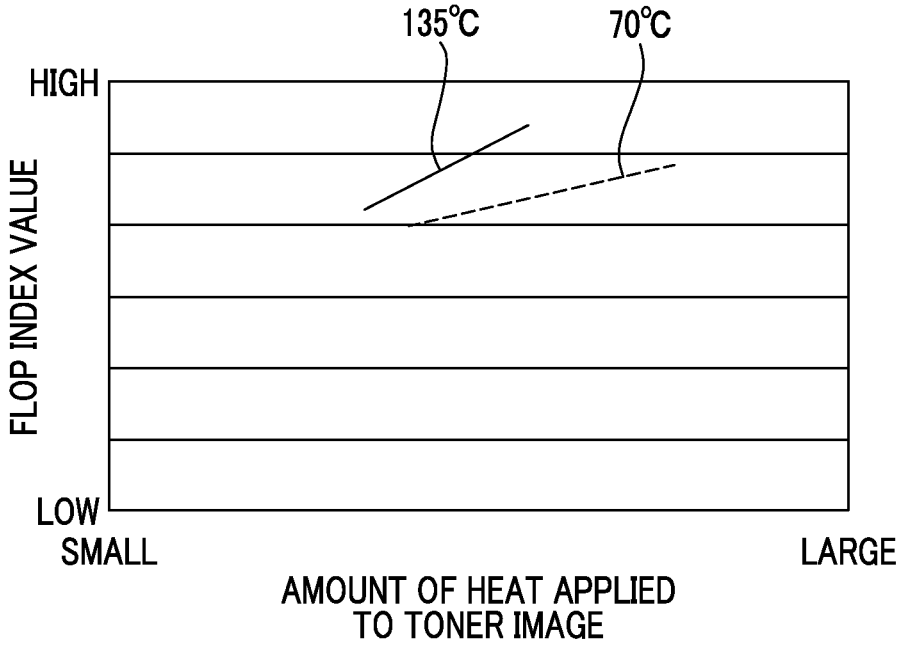
FIG. 4 is a graph illustrating a relationship between a flop index value of the toner image that is formed by the image forming apparatus according to the exemplary embodiment of the invention and an amount of heat that is applied to the toner image.

A horizontal axis of a graph in FIG. 4 represents the amount of heat that the fixing device 40 applies to the toner image formed on the sheet member P, and a vertical axis of the graph in FIG. 4 represents the flop index value.

The graph shows a relationship between the amount of heat applied to the toner image, which is changed by changing the outer surface temperature of the fixing belt 122 with the outer surface temperature of the pressurizing roller 150 being at 70[° C.], and the flop index value. Furthermore, the graph shows a relationship between the amount of heat applied to the toner image, which is changed by changing the outer surface temperature of the fixing belt 122 with the outer surface temperature of the pressurizing roller 150 being at 135[° C.], and the flop index value.

<<Evaluation Summary>>

It is apparent from the graph that the flop index value is improved by increasing the amount of heat applied to the toner image if the outer surface temperature of the pressurizing roller 150 remains unchanged. In other words, it is apparent that the flop index value is improved by increasing the amount of heat applied to the toner image from a fixing belt 122 side.

Furthermore, it is apparent that the flop index value is improved by increasing the outer surface temperature of the pressurizing roller 150 when the amount of heat applied to the toner image remains unchanged. In other words, the flop index value is improved by increasing the amount of heat applied to the toner image from the other surface (surface where the toner image is not formed) of the sheet member P when the amount of heat applied to the toner image remains unchanged.

In other words, the flop index value is improved even when the amount of heat applied to the toner image is increased. When the heat is applied to the toner image, the flop index value is more effectively improved when the amount of heat applied to the toner image from the other surface of the sheet member P is increased than when the amount of heat applied to the toner image from the one surface of the sheet member P is increased.

Hereinafter, a reason for the improvement of the flop index value following the increase in the amount of heat during the fixing of the toner image to the sheet member P will be described.

When the amount of heat is increased during the fixing of the toner image to the sheet member P, a resin binder that constitutes the toner is softened and a movement of the flat-shaped pigments 110 constituting the toner is facilitated in the binder. In this state, the toner image is pressurized toward the fixing belt 122 by the pressurizing roller 150 so that the reflecting surfaces 110A of the pigments 110 are directed to be orthogonal (X direction in the drawing) to a sheet surface of the sheet member P as illustrated in FIG. 1B. Furthermore, the pigments 110 line up in a direction (Y direction in the drawing) along the sheet surface of the sheet member P. The pigments 110 whose reflecting surfaces 110A are directed to be orthogonal to the sheet surface are arranged all over the sheet member P as illustrated in FIG. 2B.

The pigments 110 whose reflecting surfaces 110A are directed to be orthogonal to the sheet surface line up in the direction along the sheet surface as illustrated in FIG. 1B so that diffusion of reflected light reflected from the image is suppressed, as illustrated in FIG. 1A, compared to when the directions of the reflecting surfaces 110A of the pigments 110 are not constant. In this manner, the flop index value is improved.

Figure 2A:
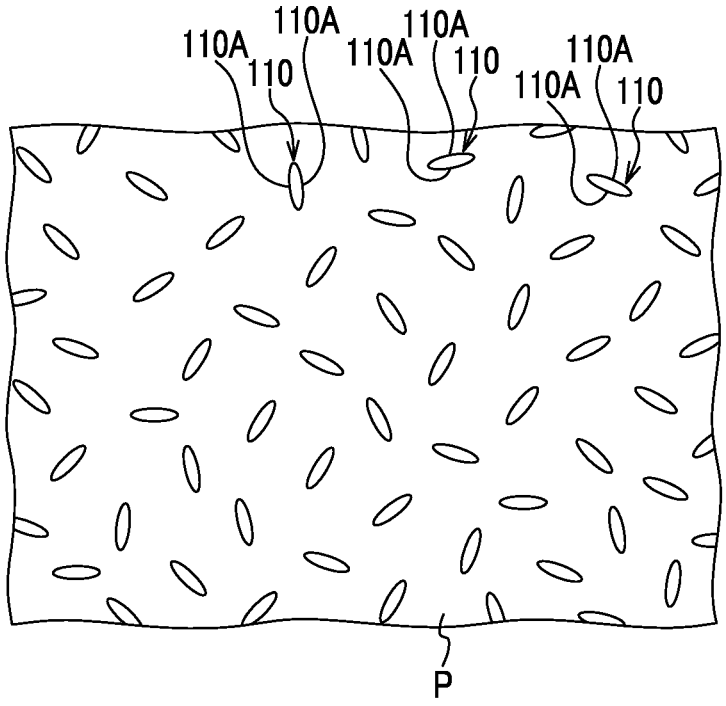
FIGS. 2A and 2B are plan views in which the postures of the flat pigments that are contained in the toner image which is formed by the image forming apparatus according to the exemplary embodiment of the invention are illustrated along with the comparative example.
Figure 2B:
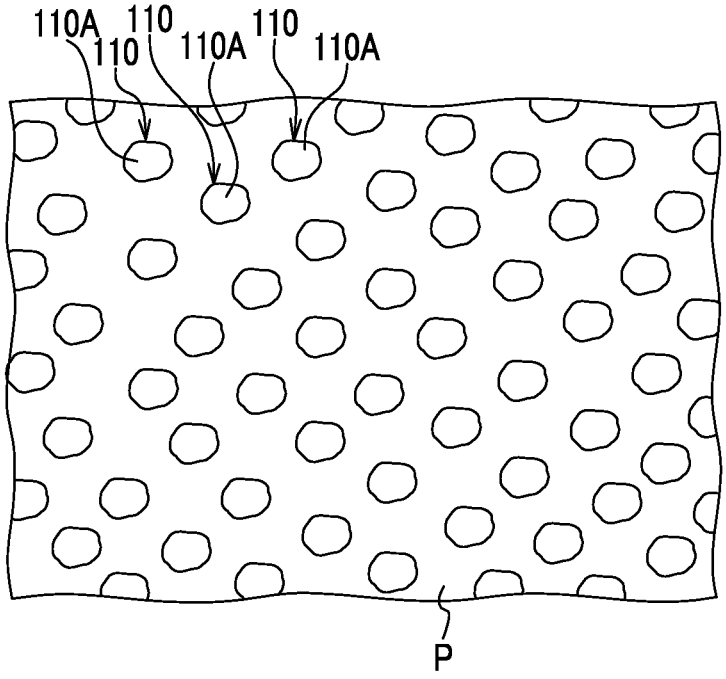

In addition, when the pigments 110 whose reflecting surfaces 110A are directed to be orthogonal to the sheet surface are arranged all over the sheet member P as illustrated in FIG. 2B, a concealing ratio, that is, a ratio of the pigments 110 concealing the sheet member P, is improved compared to when the pigments 110 having the reflecting surfaces 110A whose directions are not constant are arranged on the sheet member Pas illustrated in FIG. 2A. In other words, a reflective area, where the light that is incident from the outer surface of the sheet member P is reflected by the pigments 110, increases. The flop index value is improved in this manner as well.

Hereinafter, a reason for the effective improvement of the flop index value that follows the increase in the amount of heat applied to the toner image from the pressurizing roller 150 side when the total amount of heat applied to the image by the fixing device 40 remains unchanged, which is compared to when the amount of heat applied to the toner image from the fixing belt 122 side is increased, will be described.

As illustrated in FIG. 1B, the binder resin 111 is present also between the sheet member P and the pigments 110. Since the sheet member P is nipped between the fixing belt 122 and the pressurizing roller 150, the pigments 110 are pressed to a sheet member P side by the fixing belt 122. In this case of pressing, the reflecting surfaces 110A of the pigments 110 are along the sheet surface of the sheet member P as a degree of softening of the binder resin 111 present between the sheet member P and the pigments 110 increases, compared to when the degree of the softening is small.

When the heat is applied from a side (pressurizing roller 150 side) of the sheet member P where the toner image is not formed, the degree of the softening of the binder resin 111 present between the sheet member P and the pigments 110 increases. Accordingly, compared to when the amount of heat applied to the toner image from the fixing belt 122 side increases, the reflecting surfaces 110A of the pigments 110 are effectively along the sheet surface of the sheet member P when the amount of heat applied to the toner image from the pressurizing roller 150 side increases. As such, the flop index value is improved.

<Summary of Main Part Configuration>

As described above, when the control unit 70 receives the image forming command to apply the metallic gloss to the image (when the silver toner is used), the control unit 70 allows the sheet member, which passes through the fixing nip NF so that the toner image is fixed to the sheet member P, to pass through the fixing nip NF again. In this manner, the control unit 70 increases the amount of heat applied to the toner image compared to the amount of heat applied to the toner image at a time when the control unit 70 receives the image forming command not to apply the metallic gloss to the image (when the silver toner is not used).

In addition, when the sheet member P passes through the fixing nip NF again, the other surface of the sheet member P where the toner image is not formed is in contact with the fixing belt 122. In other words, the heat is applied to the toner image from the other surface of the sheet member P.

As is apparent from the evaluation result described above, the reflecting surfaces 110A of the pigments 110 have a posture along the sheet surface of the sheet member P when the amount of heat applied to the toner image increases. The flop index value is improved when the reflecting surfaces 110A of the pigments 110 have the posture along the sheet surface of the sheet member P.

Furthermore, when the sheet member P passes through the fixing nip NF again, the heat is applied from the other surface of the sheet member P to the toner image. In this manner, the flop index value is more effectively improved when the sheet member P passes through the fixing nip NF again than when the heat is applied from the one surface of the sheet member P to the toner image.

The certain exemplary embodiments of the invention have been described above in detail, but the invention is not limited to the exemplary embodiments described above and it will be apparent to those skilled in the art that various other exemplary embodiments may be adopted within the scope of the invention. For example, although not particularly described in the exemplary embodiment above, the one surface of the sheet member P where the toner image is formed may be in contact with the fixing belt 122 when the sheet member P passes through the fixing nip NF again. The amount of heat that is applied to the toner image may be increased in this manner. In this case, a transport path along which the sheet member P is not turned inside out is required.

In addition, although not particularly described in the exemplary embodiments above, the fixing module 120 may, for example, be configured to have only a heating roller whose outer surface is heated, without using the fixing belt 122, although the fixing module 120 is configured to have the fixing belt 122 in the exemplary embodiments above.

In addition, the toner having the silver color is used as the toner containing the flat pigment in the exemplary embodiments above but, without being limited thereto, toner having a metallic color such as a gold color may be used. The golden toner is, for example, configured to contain a flat pigment formed of aluminum or the like and a yellow pigment. In other words, the toner containing the flat pigment may contain a pigment other than the flat pigment.

In addition, the pressurizing roller 150 is rotated when the torque of the motor (not illustrated) is transmitted in the exemplary embodiments above. However, even without using a particular motor, the pressurizing roller may be driven and rotated by the fixing belt 122 that revolves when the pressurizing roller 150 and the fixing belt 122 come into contact with each other.

In addition, although not particularly described in the exemplary embodiments above, the surface temperature of the fixing belt 122 may be lower when the sheet member P passes through the fixing nip NF again than when the sheet member P passes through the fixing nip NF for the first time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image unit configured to use toner which contains a flat pigment;

a second image unit configured to use toner which does not contain a flat pigment; and a fixing unit configured to fix an image which is formed on a recording medium to the recording medium by using heat while transporting the recording medium, wherein the image forming apparatus is configured such that the recording medium is transported again to the fixing unit after an image formed on the recording medium by the toner containing the flat pigment is fixed to the recording medium by the fixing unit.

2. The image forming apparatus according to claim 1, wherein the fixing unit includes a heating member that comes into contact with one surface of the recording medium where the image is formed and heats the image to fix the image to the recording medium when the recording medium is transported to the fixing unit for the first time, and wherein the other surface of the recording medium and the heating member come into contact with each other when the recording medium is transported again to the fixing unit.

3. The image forming apparatus according to claim 1, wherein the flat pigment comprises a metal.

4. The image forming apparatus according to claim 1, wherein the fixing unit comprises a fixing nip NF, and wherein the image forming apparatus is configured such that the recording medium is transported to the fixing nip NF for primary fixing, is subsequently transported away from the fixing nip NF, and then, in response to the image formed on the recording medium by the toner containing the flat pigment being fixed to the recording medium as a result of the primary fixing, is subsequently transported again to the fixing nip NF for secondary fixing.

5. The image forming apparatus according to claim 1, wherein the flat pigment has a substantially flat surface.

6. The image forming apparatus according to claim 1, wherein the flat pigment has a flat surface.

7. An image forming apparatus comprising:

a first image unit configured to use toner which contains a flat pigment;

a second image unit configured to use toner which does not contain a flat pigment; and a fixing unit configured to fix an image which is formed on a recording medium to the recording medium by using heat while transporting the recording medium, wherein the image forming apparatus is configured such that, in response to an image formed on the recording medium by the toner containing the flat pigment being fixed to the recording medium by the fixing unit, the recording medium is transported again to the fixing unit for secondary fixing, and wherein the image forming apparatus is configured such that, in response to an image formed on the recording medium without any toner containing the flat pigment being fixed to the recording medium by the fixing unit, the recording medium is discharged without being transported to the fixing unit again.

* * * * *